US012084881B1

(12) United States Patent
Bahamonde et al.

(10) Patent No.: US 12,084,881 B1
(45) Date of Patent: Sep. 10, 2024

(54) HYDRAULIC DEVICE TO DEPLOY A BLEACHER SYSTEM

(71) Applicant: BahaWex Manufacturing Inc., Boynton Beach, FL (US)

(72) Inventors: Michael Bahamonde, Boynton Beach, FL (US); Andrew Hall, Boynton Beach, FL (US)

(73) Assignee: BahaWex Manufacturing Inc., Boynton Beach, FL (US)

( * ) Notice: Subject to any disclaimer, the term of this patent is extended or adjusted under 35 U.S.C. 154(b) by 0 days.

(21) Appl. No.: 17/899,108

(22) Filed: Aug. 30, 2022

Related U.S. Application Data

(60) Provisional application No. 63/238,465, filed on Aug. 30, 2021.

(51) Int. Cl.
*E04H 3/12* (2006.01)

(52) U.S. Cl.
CPC ..... *E04H 3/126* (2013.01)

(58) Field of Classification Search
CPC ..... E04H 3/126; E04H 3/123
See application file for complete search history.

(56) References Cited

U.S. PATENT DOCUMENTS 2,587,159 A 2/1952 Holmes
3,752,531 A 8/1973 Jones
3,914,909 A 10/1975 McNeal
4,412,403 A 11/1983 LeFranc et al.
4,611,439 A 9/1986 Graham, Jr.
5,660,000 A * 8/1997 MacIntyre ..... E04H 3/126 52/9
D404,141 S 1/1999 Borglum
5,979,125 A 11/1999 Guillet
6,499,258 B1 12/2002 Borglum
7,234,720 B2 6/2007 Borglum
7,739,838 B2 6/2010 Borglum et al.
8,296,999 B2 10/2012 Uhl
8,678,941 B2 3/2014 Bilsen et al.
9,021,746 B1 5/2015 Uhl
9,200,462 B2 12/2015 Valente et al.
(Continued)

FOREIGN PATENT DOCUMENTS

AU 2012254953 B2 12/2012
CA 3085085 A1 * 2/2021 ..... A61B 5/1115
(Continued)

*Primary Examiner* — Babajide A Demuren
(74) *Attorney, Agent, or Firm* — John Rizvi; John Rizvi, P.A—The Patent Professor®

(57) ABSTRACT

A control system guides and supports the deployment of a folded, collapsed bleacher system. The control system includes a hydraulic device implemented as a piston-cylinder combination anchored at one end to the trailer frame carrying the stowed bleacher and anchored at another end to an undercarriage support member of the bleacher. The movement of the piston exerts a tandem pivoting action on the front and rear bleacher sections, which deploys and opens the bleacher system to a level, seating-ready configuration. A weight detection module senses the approach of a free-fall condition of the bleacher system during deployment and increases the applied resistance of the piston-cylinder combination, controlling the rate of descent of the bleacher system to avoid free-fall.

18 Claims, 12 Drawing Sheets

(56) References Cited

U.S. PATENT DOCUMENTS

| | | | | |
|---|---|---|---|---|
| 2012/0209502 | A1* | 8/2012 | Nichols | B62D 53/021 701/124 |
| 2021/0276848 | A1* | 9/2021 | Miller | B66F 9/12 |

FOREIGN PATENT DOCUMENTS

| | | | | |
|---|---|---|---|---|
| CN | 102535893 | A * | 7/2012 | E04H 3/126 |
| EP | 2617917 | A2 * | 7/2013 | E04H 3/126 |
| GB | 2204338 | A | 11/1988 | |
| GB | 2394481 | A | 4/2004 | |
| KR | 102363156 | B1 * | 5/2019 | |
| WO | 9947769 | A1 | 9/1999 | |
| WO | 0011288 | A1 | 3/2000 | |

* cited by examiner

HYDRAULIC DEVICE TO DEPLOY A BLEACHER SYSTEM

CROSS-REFERENCE TO RELATED APPLICATIONS

This application claims the benefit of U.S. Provisional Patent Application Ser. No. 63/238,465, filed on Aug. 30, 2021, which is incorporated herein in its entirety.

FIELD OF THE INVENTION

The present invention relates generally to an apparatus designed to unfold or open a collapsed bleacher system, and, more particularly, to a hydraulic device having a piston-cylinder combination configured to deploy a bleacher system from a closed position, and further configured with a weight detection feature that adjusts the rate of piston travel in response to the detection of a free-fall condition to slowly open the bleacher system and prevent an excessive and unsafe rapid-descent deployment of the bleacher system.

BACKGROUND OF THE INVENTION

Generally, bleachers, or commonly also known as stands, are raised, tiered rows of benches generally found at sports fields and other spectator events. Bleacher structures vary depending on the venue and its need. There are a number of bleacher structures on the market, including permanent, stationary bleachers, telescopic/folding bleachers, or portable bleacher structures. While foldable and permanent bleacher structures are unmovable from their location, portable bleachers present an excellent solution for providing seating areas that can be moved between multiple locations.

Movable or portable bleachers generally include unreliable mechanisms that enable a person to collapse the movable bleacher and transport it from one location to a different location. Once at the new location site, the portable bleacher can be unhitched from the vehicle used to transport the bleacher and erect the movable bleacher for use during an event, such as a sporting event.

Movable bleachers, however, are fraught with deficiencies. On average, approximately ten thousand bleacher-related injuries occur each year. Many of these injuries occur to persons who transport and erect movable bleachers. For instance, collapsed bleachers need to be erected once they are transported to an erection site. The bleachers are heavy and difficult to manage, and more often than not, include inadequate deployment mechanisms to be safely erected. Moreover, as is typically the case, movable bleachers are handled with few people, making it difficult to handle large bleacher structures. As the bleachers are erected, their size and weight can be difficult to manipulate, leading to injuries of persons.

Accordingly, there is an established need for an apparatus designed to deploy a bleacher system from its collapsed, stowed, closed position to its unfolded, operational, open position in a safe, effective, and economical way requiring no manual intervention and adapted to provide an automatic control feature regulating the rate of deployment to prevent uncontrolled, gravity-assisted free-fall of the bleacher unit as the main bleacher sections begin its descent.

SUMMARY OF THE INVENTION

The present invention is directed to a hydraulic device that facilitates the deployment of a stowed bleacher, supporting and guiding the bleacher as it transitions from a closed, folded, collapsed position to an open, unfolded, level position. The hydraulic device employs a piston-cylinder combination to effectuate the tandem pivoting action of the bleacher sections to deploy the bleacher system. In one form, the present invention includes a control system configured to guide and support the deployment of a folded, collapsed bleacher system. The control system includes a hydraulic device implemented as a piston-cylinder combination anchored at one end to the trailer frame carrying the stowed bleacher and anchored at another end to an undercarriage support member of the bleacher. The movement of the piston exerts a tandem pivoting action on the front and rear bleacher sections, which deploys and opens the bleacher system to a level, occupant-ready seating configuration. A weight detection module senses the approach of a free-fall condition of the bleacher system during deployment and increases the applied resistance of the piston-cylinder combination, controlling the rate of descent of the bleacher system to avoid free-fall.

Introducing a first embodiment of the invention, the present invention consists of semi-automated deployable bleacher system, comprising:

- a hydraulic device operatively configured in one or more modes to transition a bleacher system from one condition to a second condition;
- a weight detection module configured to sense a load applied by the bleacher system and to generate a load signal representative thereof; and
- a controller configured to control the hydraulic device in response to the load signal from the weight detection module.

In a second aspect, the hydraulic device is configured to exert a pivoting action on the bleacher system.

In another aspect, the piston is configured to operate in a retraction mode to draw the bleacher system open.

In yet another aspect, the controller is configured further to regulate a rate of descent of the bleacher system by suitable control of the hydraulic device in response to a load signal indicative of an applied load satisfying a threshold criteria.

In yet another aspect, the regulation of the rate of descent includes a decrease in the rate of descent.

In another aspect, the weight detection module may include one or more sensors that are configured to sense the load applied while the bleacher system transitions one condition to another.

In another aspect, the weight detection module may electronically communicate with the controller to signal the hydraulic device to moderate the rate of descent of the bleacher system as the bleacher system opens and closes. In this regard, the controller may adjust the pressurization of the hydraulic device based on a load measurement detected by the weight detection module. Thereby moderating the rate of descent of the bleacher system as it transitions from the one condition to the second condition In another aspect, the weight detection module may include sensors capable of detecting an incipient free-fall of the bleacher system and transmits an immediate signal to the controller to increase resistance applied by the hydraulic device on the bleacher system. The increased resistance may lessen the descent rate or impede it.

In another aspect, the controller may be wirelessly connected to the hydraulic device and the weight detection module over a wireless communication medium such as Bluetooth, wi-FI, or any other available medium.

In another aspect, the bleacher system may comprise an upper bleacher section and a lower bleacher section pivotally connected at a common pivot joint, and include a fence system removably attached to one or more sides or ends of the bleacher system.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention, in a first embodiment, is directed toward a control system configured to manage, direct and otherwise control the deployment of a bleacher system. In one form, the control system includes a hydraulic device implemented as a piston-cylinder combination that controls the rotary, pivoting action of the bleacher system and is capable of maneuvering and otherwise reconfiguring the bleacher system from a closed position to an open position and vice-versa. The first embodiment of the present invention is disclosed in FIGS. 1-7 and 11-12. The present invention, in a second embodiment, is directed toward a removable fence system that defines a side and/or rear boundary or periphery enclosure of the bleacher system. The second embodiment of the present invention is disclosed in FIGS. 8-10.

Figure 1:
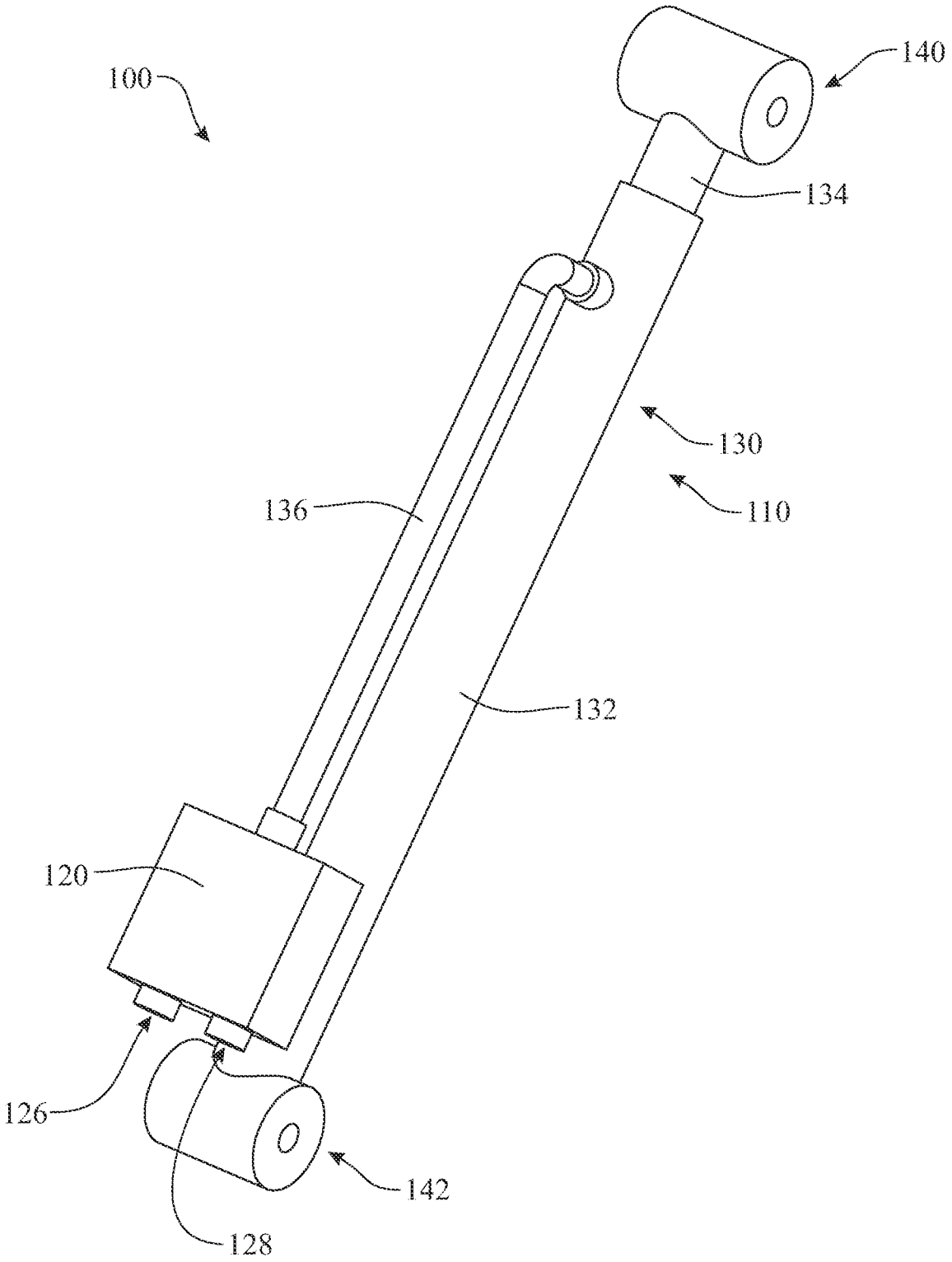
FIG. 1 presents a front-side perspective view of a hydraulic device configured to control the deployment of a bleacher system according to a first embodiment of the present invention, illustrating the hydraulic device in a generally vertical orientation.
Figure 2:
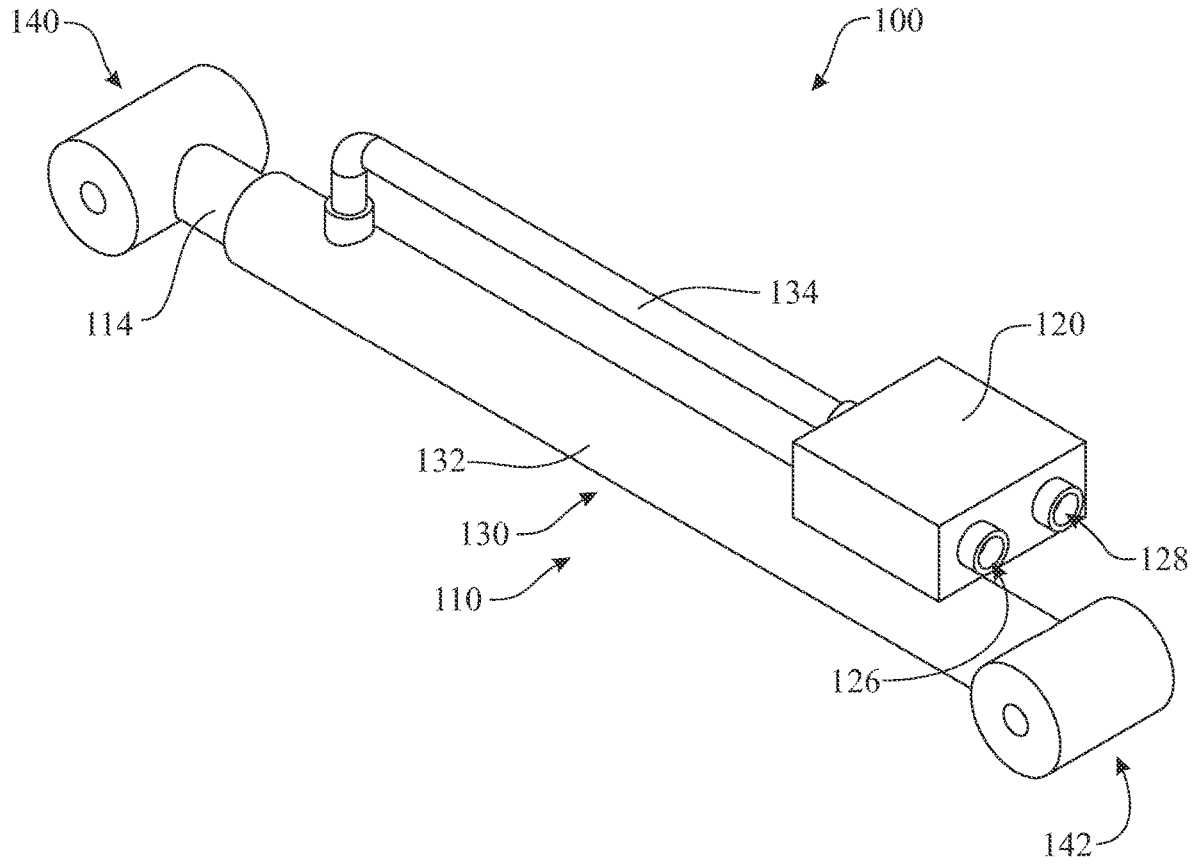
FIG. 2 presents a lateral perspective view of the hydraulic device according to the first embodiment of the present invention, illustrating the hydraulic device in a generally horizontal orientation.

Referring initially to FIGS. 1 and 2, a bleacher control system or device 100 is disclosed, according to a first embodiment of the present invention. The control system 100 includes a hydraulic device generally illustrated at 110. In one form, the hydraulic device is configured as a piston-cylinder combination 130 having a cylinder 132 and a piston 134 telescoped and reciprocating within cylinder 132 in response to the application of hydraulic fluid. The hydraulic device 110 is controlled by pressurized hydraulic fluid communicated to the piston-cylinder combination 130 via illustrative hydraulic line 136. The hydraulic device 110 supports reciprocating, two-way movement of piston 134 relative to cylinder 132 in an advancing and retracting mode.

Referring briefly to FIGS. 3 and 5-7, the control system 100 of the present invention is available for use with any conventional bleacher system such as the one generally illustrated at 10. As shown, the bleacher system 10 is carried on a conventional transport such as a trailer 12. In one form, the bleacher system 10 includes a front or lower section 20 and a rear or upper section 22, which are pivotally connected or rotatably coupled to a common pivot or rotary axis generally illustrated at 24. In a conventional manner, the lower bleacher section 20 and upper bleacher section 22 pivot or rotate in tandem or unison. In one illustrative form, the lower bleacher section 20 has a set of five (5) seating rows and the upper bleacher section 22 has a set of five (5) seating rows. Counting from the lowermost or front-most row, the pivot axis 24 is generally located at the transition from the last row of lower bleacher section 20 and the first row of upper bleacher section 22, namely, row 5 (generally illustrated at 30) and row 6 (generally illustrated at 32). In a conventional or standard arrangement, each bleacher section 20, 22 is supported underneath by a set of individual spaced-apart support members or rails such as representative support member 40. The bleacher system 10 is stowed or stored for transport or travel in a folded, closed or collapsed configuration generally illustrated at FIGS. 3 and 5, in which the seating rows of bleacher sections 20, 22 are interleaved or nested with one another. In this closed configuration, the bleacher system 10 adopts or occupies a generally vertical orientation. In its deployed condition, generally illustrated at FIGS. 7-8, the bleacher system 10 adopts an unfolded, open configuration in which the lower bleacher section 20 and upper bleacher section 22 form a contiguous seating area or platform. The deployment from the folded, closed configuration to the unfolded, open configuration involves a pivoting action applied to at least one of the bleacher sections 20, 22. In a conventional manner, a rotary displacement of one bleacher section 20 effectuates a commensurate rotary or pivoting displacement of another bleacher section 22. In this way, the bleacher sections 20, 22 have a dependent, coordinated movement. The mechanical fixtures, connections and linkages to facilitate this tandem, simultaneous, united pivoting action are well known to those skilled in the art. Additional aspects and features of the construction for bleacher system 10, such as articulated linkages and other connection pieces, are well known to those skilled in the art.

Figure 4:
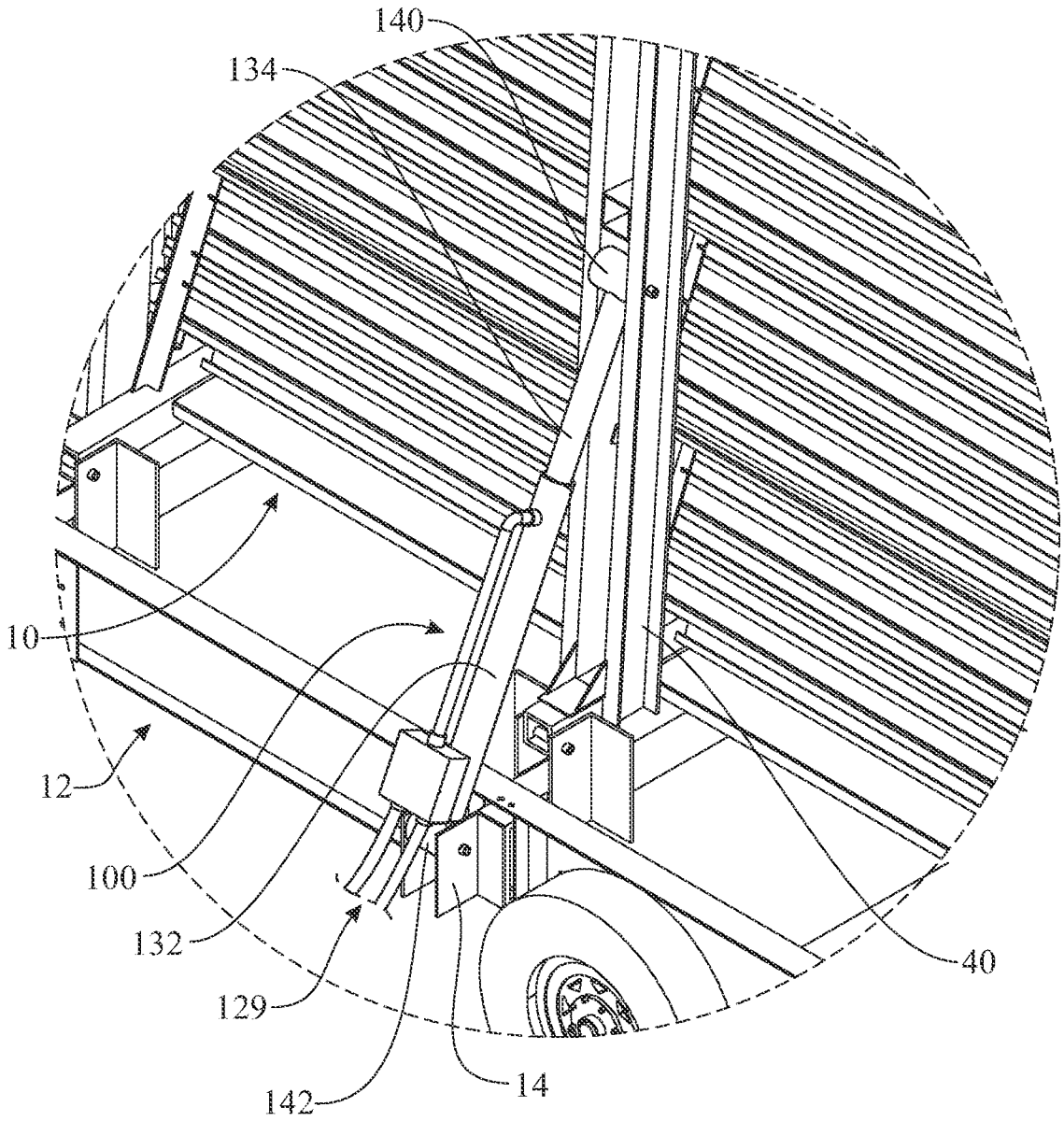
FIG. 4 presents an expanded, sectional, perspective view showing the operational installation of the hydraulic device according to the first embodiment of the present invention, illustrating how the hydraulic device is configured in a fully extended mode to engage a support member of the bleacher system in its closed, stowed position.

Referring again to FIGS. 1 and 2, with further reference to FIG. 4, the control system 100 is configured with an upper mount device 140 and a lower mount device 142. In one form, the lower mount 142 is disposed at a free lower end of cylinder 132 and the upper mount 140 is disposed at a free upper end of piston 134. During installation of control system 100, the lower mount 142 is rigidly fixed to trailer 12, such as at a frame section or bracket 14, which anchors the piston-cylinder combination 130 to a stable foundation. Additionally, during installation, the upper mount 140 is rigidly fixed to an underside support member 40 of bleacher system 10 (i.e., part of the undercarriage, chassis, or foundation of bleacher system 10). Any conventional means known to those skilled in the art can be used to fixedly secure the control system 100 to trailer 12 and bleacher system 10. In one form, for example, the upper and lower mounts 140, 142 can be provided in the form of a collar-style bearing device having a through-hole to fit a bolt or other suitable fastener that secures the mounts 140,142 to their corresponding structure.

The control system 100 further includes a weight detection module generally illustrated at 120. The weight detection module 120 is configured to detect the load bearing induced by the weight of the bleacher system 10. When the applied load reaches a predetermined amount or level corresponding to a threshold criterion, the weight detection module 120 modulates or regulates the operation of the hydraulic device 110 with a view towards decreasing the rate of descent of the bleacher system 100. For this purpose, the weight detection system 120 is disposed inline between the source of pressurized hydraulic fluid (not shown) and the hydraulic line 136 directly connected to the piston-cylinder combination 130. The weight detection system 120 is provided at an input end with a set of hydraulic ports 126, 128 that are connected to the hydraulic fluid supply, for example, one port could be connected to the high-pressure fluid supply line and the other port could be connected to the low-pressure fluid return line. The connection to the hydraulic fluid supply is shown by the set of hoses 129 connected to the ports 126, 128 of the weight detection module 120. Any suitable mechanism can be provided in the weight detection module 120 to perform the functionality of measuring, sensing, and otherwise detecting the weight-bearing load applied by the bleacher system 10.

Additionally, any suitable mechanism can be provided in the weight detection module 120 to modulate, regulate, and otherwise control the hydraulic device 110 according to the applied load measurement. This control functionality can adopt any of various forms known to those skilled in the art. In one form, for example, the hydraulic pressurization of the piston-cylinder combination 130 can be adjusted based on the applied load measurement. This adjustment, for example, can effectuate a controlled rate of descent of the bleacher system 10, such as reducing or decreasing the piston travel corresponding to deployment (e.g., piston retraction).

Figure 3:
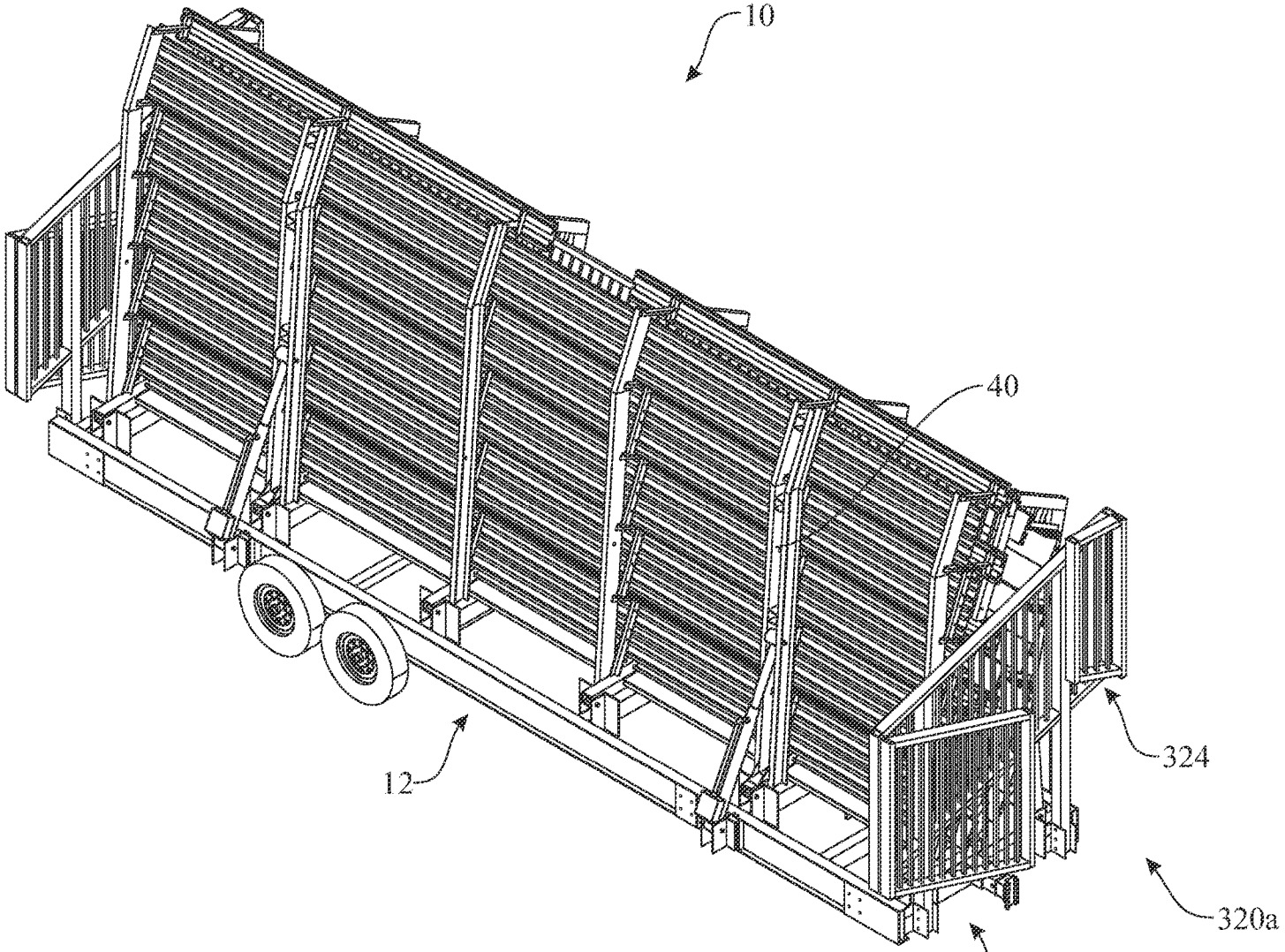
FIG. 3 presents an upper perspective view of a conventional bleacher system in its stowed, collapsed, raised condition, for use with the hydraulic device according to the first embodiment of the present invention.
Figure 5:
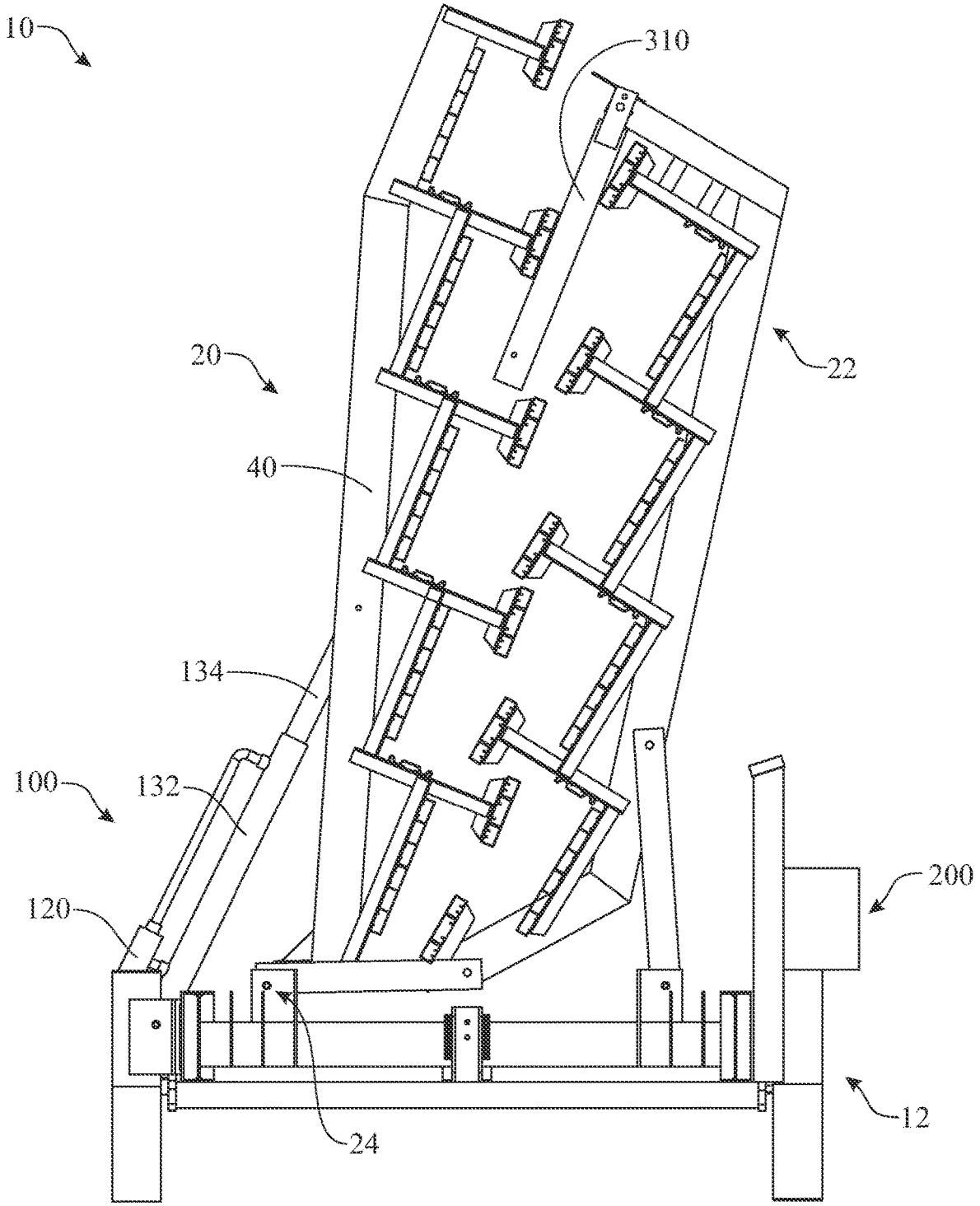
FIG. 5 presents a side elevation view showing how the hydraulic device according to the first embodiment of the present invention is arranged for connection to the bleacher system as depicted in its folded, closed position and stowed on a carrier transport.

The weight detection module 120 can adopt various modes of operation. One safety hazard potentially encountered during deployment (the transition from closed to open position) involves the possibility of a free-fall condition at a certain point during the pivoting displacement of bleacher sections 20, 22. The weight detection module 120 can be programmed to sense an incipient free-fall condition of bleacher system 10 during deployment, which can be determined using a threshold load level or other relevant criterion. When this free-fall condition is detected, the weight control module 120 can adjust the hydraulic pressurization of hydraulic device 110 to effectively increase the amount of resistance to the displacement experienced by piston-cylinder combination 130, which in turn slows down the rate of descent and gently sets the bleachers down. For example, in the implementation disclosed herein, the closed position of the bleacher system 10, as seen in FIGS. 3-5, corresponds to an extended position of piston 134 of piston-cylinder combination 130 of hydraulic device 110. As discussed further, the deployment of bleacher system 10 involves a gradual retraction of piston 134. In the event the weight detection module 120 detects a bleacher-induced load condition exceeding or meeting a particular threshold, the weight detection module 120 adjusts the operation of piston-cylinder combination 130 to decrease or reduce the rate of retraction of piston 134. The travel of piston 134 can be adjusted to a certain level or setting so that the piston 134 subsequently retracts at a fixed, slower rate (i.e., a static rate of travel). Alternately, the travel of piston 134 can be modified in a dynamic way based on the applied load measured by weight detection module 120. In this operating mode, the travel of piston 134 is varied on a continuous basis in accordance with the applied load measurement. For example, the variable speed of travel of piston 134 can feature a progressive reduction as the bleacher system 10 cycles towards full deployment (i.e., the bleacher system 10 gradually shifts from the vertical to horizontal position) and the applied load gradually increases.

Figure 7:
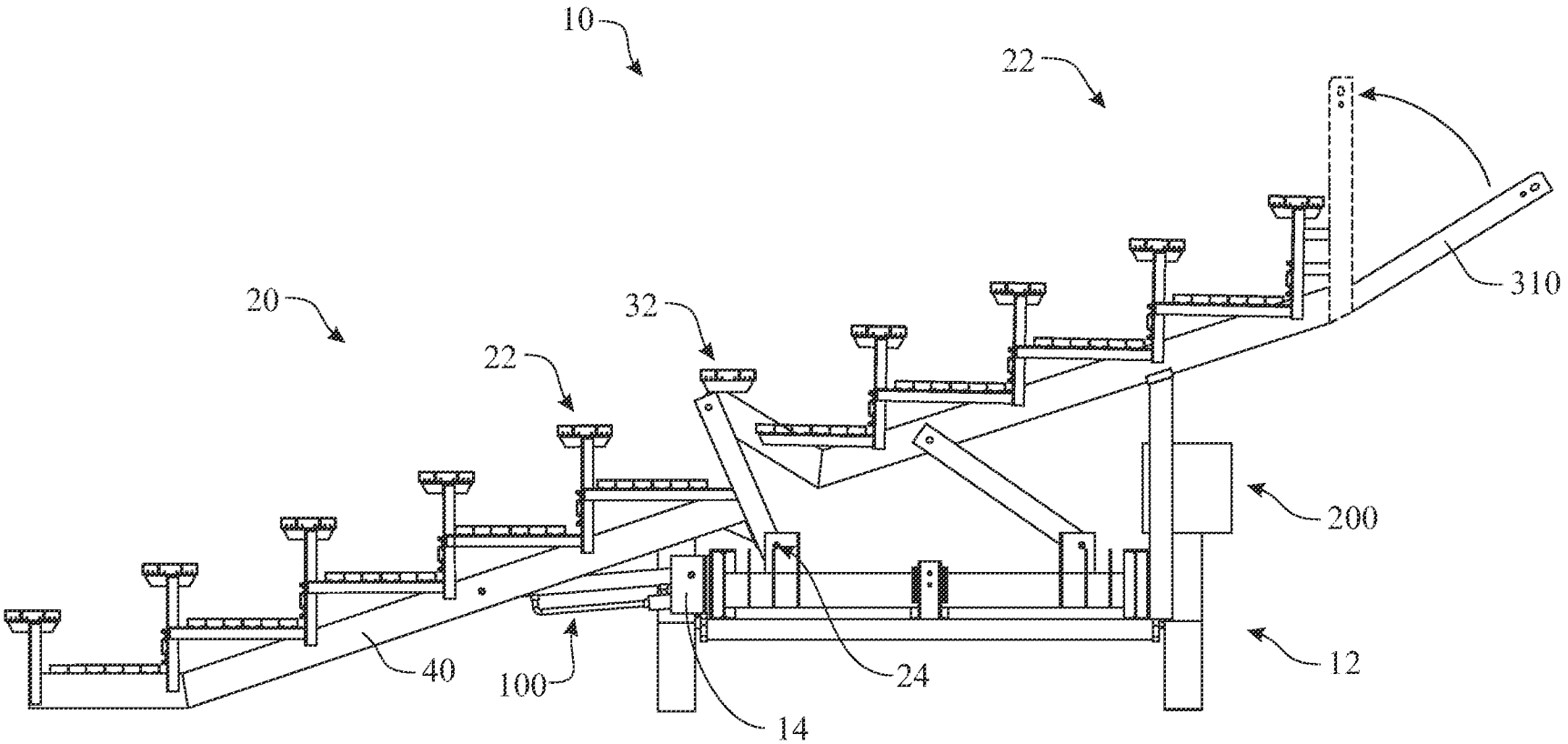
FIG. 7 presents a side elevation view showing the arrangement of the hydraulic device according to the first embodiment of the present invention following the complete deployment of the bleacher system, which is depicted in a fully open and lowered condition.
Figure 11:
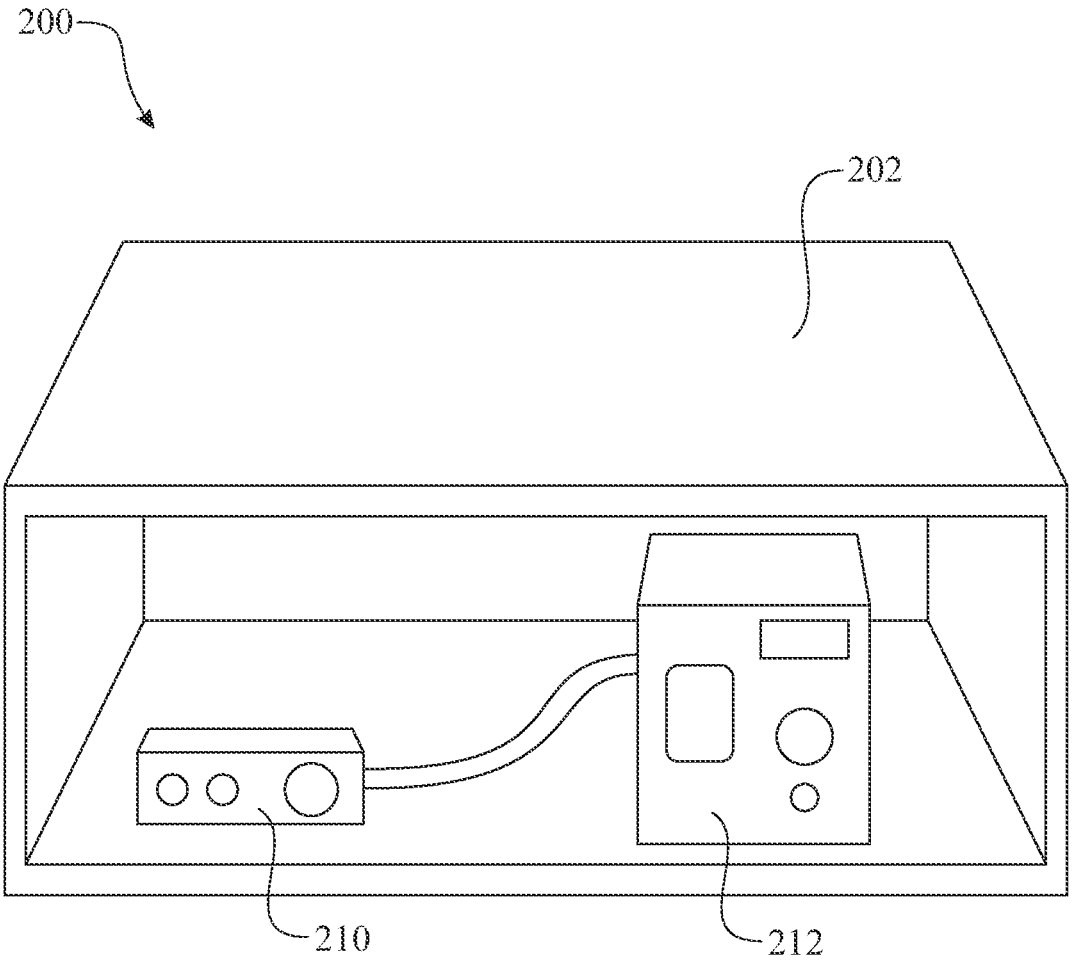
FIG. 11 presents a front perspective view of a control unit for use with the hydraulic device originally disclosed in FIGS. 1-7 according to the first embodiment of the present invention.
Figure 12:
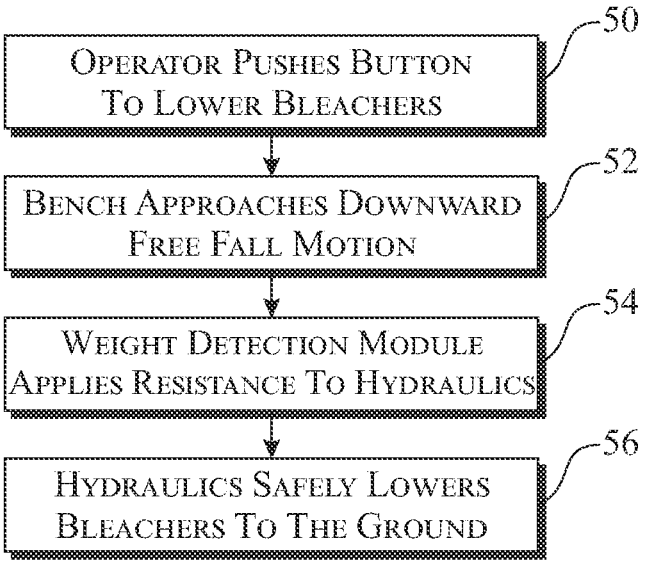
FIG. 12 presents a flow diagram illustrating one operating sequence for managing and directing the operation of the hydraulic device originally disclosed in FIGS. 1-7 according to the first embodiment of the present invention.

Referring to FIG. 11, a control box 200 is disclosed that the user accesses to manage, control and otherwise direct the operation of control system 100. The control box 200 includes a push-button selector switch 210 and an accompanying battery 212 housed in an enclosure 202, which is preferably mounted on one side of trailer 12 (FIG. 7). The selector switch 210 is configured with appropriate push-button selections to activate the hydraulic device 110, namely, to operate the piston-cylinder combination 130 in a piston-retract mode (deploy bleacher system 10, featuring a transition from a closed to open position) or a piston-advance mode (collapse bleacher system 10, featuring a transition from an open to closed position). The control box 200 can be carried on the vehicle transport 12, as shown in FIGS. 5 and 7.

Referring now to FIGS. 3-7 and 12, the operation of control system 100 is now disclosed. In its upright, stowed, fully folded and closed position, the bleacher system 10 is suitably arranged with hydraulic device 110 such that the piston 134 of piston-cylinder combination 130 is in a fully extended condition (FIG. 4). The present invention is concerned with ensuring an appropriate balance of forces between those attributed to gravity (the weight of bleacher system 10) and those attributed to control system 100 (the guided support offered by piston-cylinder combination 130), in order to ensure that bleacher system 10 is safely deployed and a gravity-induced free-fall condition is avoided. On the side of bleacher system 10, the bleacher system 10 exerts a gravity-induced weight-bearing load in the vertical direction that is resolved into tangential and normal components. The tangential component is directed along the plane of support member 40, while the normal component is directed orthogonally to the plane of support member 40 and generally oriented in the downward direction. In the upright position shown in FIG. 5, the entire force vector exerted by bleacher system 10 is tangential, i.e., along the plane of support member 40. However, as the bleacher system 10 deploys and moves gradually from the fully closed position (FIG. 5) to the fully open position (FIG. 7), the gravity-induced tangential vector decreases and the gravity-induced normal vector increases, the maximum normal vector and minimum tangential vector are reached at the fully open position (FIG. 7).

It is the gravity-induced normal vector that warrants attention in terms of observing (and avoiding) the free-fall condition of bleacher system 10. On the side of control system 100, the piston-cylinder combination 130 develops a force vector that is likewise resolved into tangential and normal components. The tangential component is directed along the plane of support member 40 (opposing the gravity-induced tangential force component from bleacher system 10), while the normal component is directed orthogonally to the plane of support member 40 and generally oriented in the upwards direction (opposing the gravity-induced normal force component from bleacher system 10 that is generally oriented in the downwards direction). As long as the upward-directed normal force component provided by piston-cylinder combination 130 is equal to or greater than the downward-directed, gravity-induced normal force component exerted by bleacher system 10, the rate of descent of bleacher system 10 can be controlled to provide a safe, speed-regulated deployment. The weight detection module 120 is used to determine the approach of a free-fall condition of bleacher system 10, a point at which the downward-tending, gravity-induced normal force component exerted by bleacher system 10 exceeds the counter-balancing, upward-tending normal force component offered by the piston-cylinder combination 130. When this occurs, the hydraulic control functionality of weight detection module 120 applies additional hydraulic-based resistance to the piston-cylinder combination 130 to increase the normal force component offered by the piston-cylinder combination 130 and return the rate of descent of bleacher system 10 to a safe condition avoiding a free-fall event. The adaptive response of the weight detection module 120 to the gravity-induced weight-bearing load exerted by bleacher system 10 is preferably performed automatically.

Figure 6:
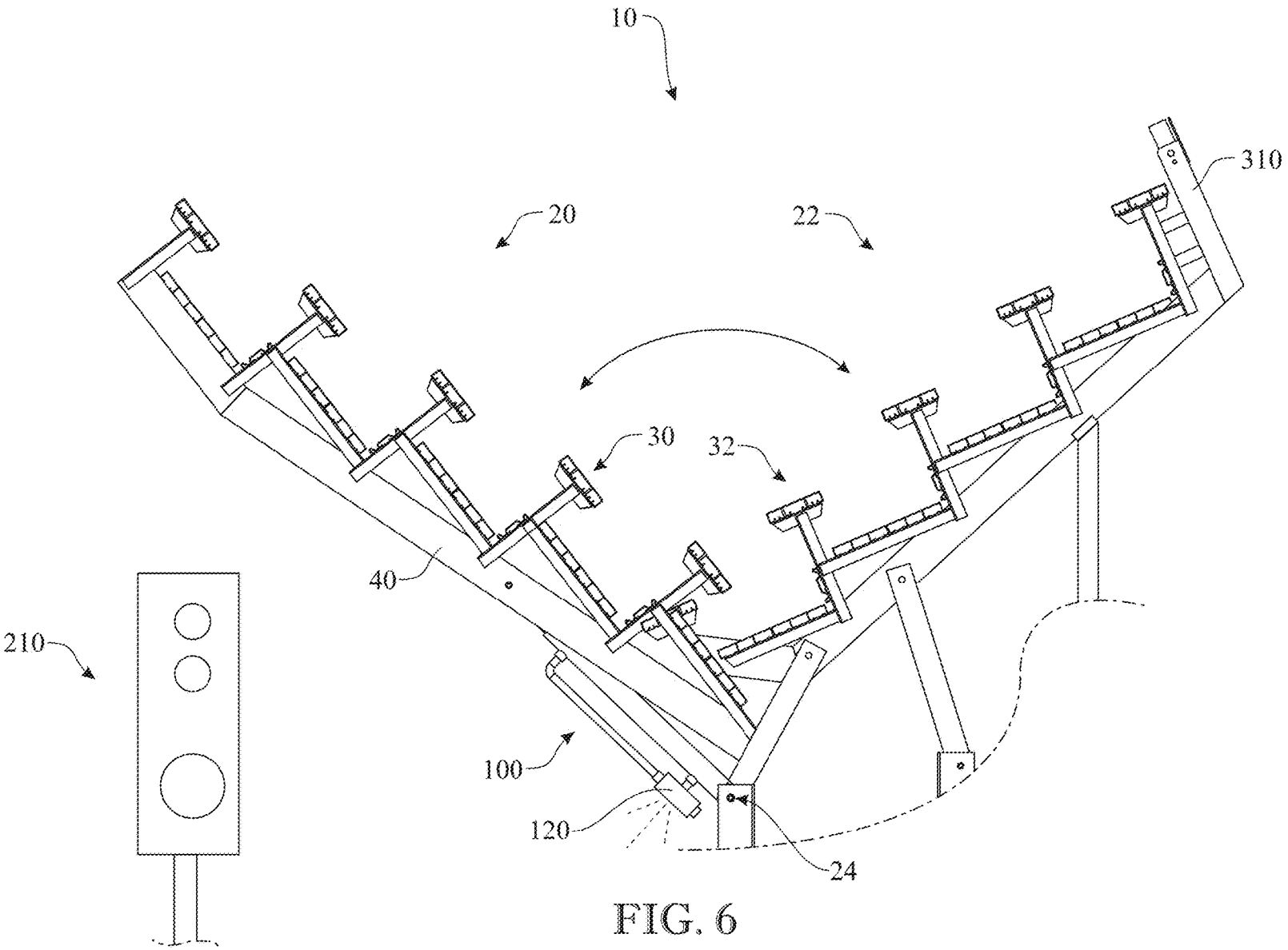
FIG. 6 presents a side elevation view showing activation of the hydraulic device according to the first embodiment of the present invention in order to deploy and unfold the bleacher system, which is depicted in a partially open condition, and further showing a mode of operation of the hydraulic device configured to control the rate of descent of the bleacher system in response to the detection of a threshold weight-bearing condition signifying proximity to a free-fall condition.

The bleacher system 10 is preassembled and pulled behind a truck on a trailer transport 12. The trailer 12 is parked at the desired location for deploying bleacher system 10. The bleacher system 10 is then disconnected from trailer 12. The bleacher system 10 is then leveled to prepare for deployment. At this point, the bleacher system 10 is in its fully closed position (FIG. 5). Referring to the operating sequence in FIG. 12, the user then accesses control box 200 and operates the selector switch 210 to initiate bleacher deployment by activation of piston-cylinder combination 130 of hydraulic device 110 (step S0). In the configuration shown, the piston 134 is in a fully extended position when the bleacher system 10 is in its fully closed condition (FIG. 4). During the deployment mode, the activation of hydraulic device 110 effectuates a retraction of piston 134 of piston-cylinder combination 130. This retraction exerts a downward-tending pivoting action on front bleacher section 20 (via bleacher support member 40), which starts to rotate about pivot axis 24. Due to the interconnection between bleacher sections 20 and 22, the rear bleacher section 22 will move in tandem with front bleacher section 20, so that both bleacher sections 20, 22 will simultaneously pivot in tandem in their respective angular directions of deployment (FIG. 6). FIG. 6 is a representation of an intermediate point of deployment between the fully closed position (FIG. 5) and the fully open position (FIG. 7). FIG. 6 also illustratively depicts what happens when the deployment reaches a point where the weight detection module 120 senses the onset or incipient appearance of a free-fall condition of bleacher system 10 (step S2). In response, the weight detection module 10 arrests development of the free-fall condition by applying a suitable amount of resistance to hydraulic device 110, which appropriately increases the amount of force applied by the piston-cylinder combination 130 to support bleacher system 10 (step S4). In effect, the piston 134 exerts an increased force against bleacher system 10 (via support member 40) and experiences a slower or reduced rate of retraction that counter-acts or offsets the incipient free-fall action of bleacher system 10. As a result, the rate of descent of bleacher system 10 is restored to a stable equilibrium condition in which the deployment of bleacher system 10 is again placed under the direction, control and management of control system 100 and the incipient free-fall action is neutralized (step S6). The deployment continues until the bleacher system 10 is fully open (FIG. 7).

As shown in the figures, during deployment as the folded bleacher system 10 opens, the front 5 rows (of front bleacher section 20) pivot toward ground; eventually, after sufficient angular displacement of bleacher sections 20 and 22, row 1 lands on the ground and rows 5 and 6 meet together, so that the whole system goes up level and features rows 5 and 6 as the pivot point. It is a significant feature of the present invention that the weight detection module 120 senses the approach of a free-fall event for bleacher system 10. If free-fall is allowed to occur or commence, it is difficult if not impossible to recover from this event, which makes it vitally important to recognize the incipient appearance of a free-fall condition so that counter-measures can be adopted (i.e., increase the resistance applied by piston-cylinder combination 130 to bleacher system 10). The control system 100 can be used to facilitate the transition of bleacher system 10 from its open to closed position by a reverse operation of hydraulic device 110, i.e, the piston 134 of piston-cylinder combination 130 is activated to extend or advance.

Figure 8:
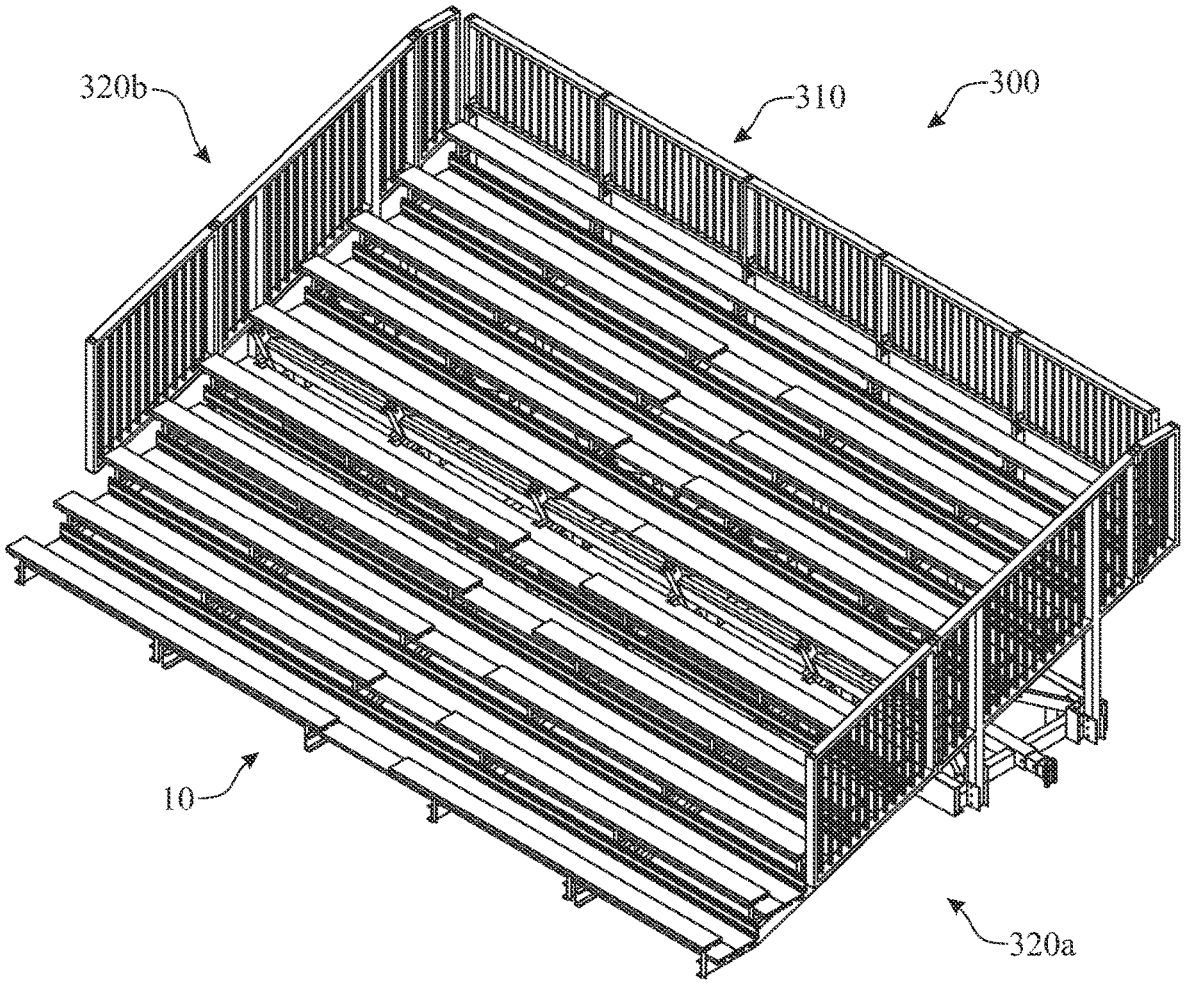
FIG. 8 presents an upper front perspective view of a bleacher system configured with a removable independent safety fence system according to a second embodiment of the present invention.
Figure 9:
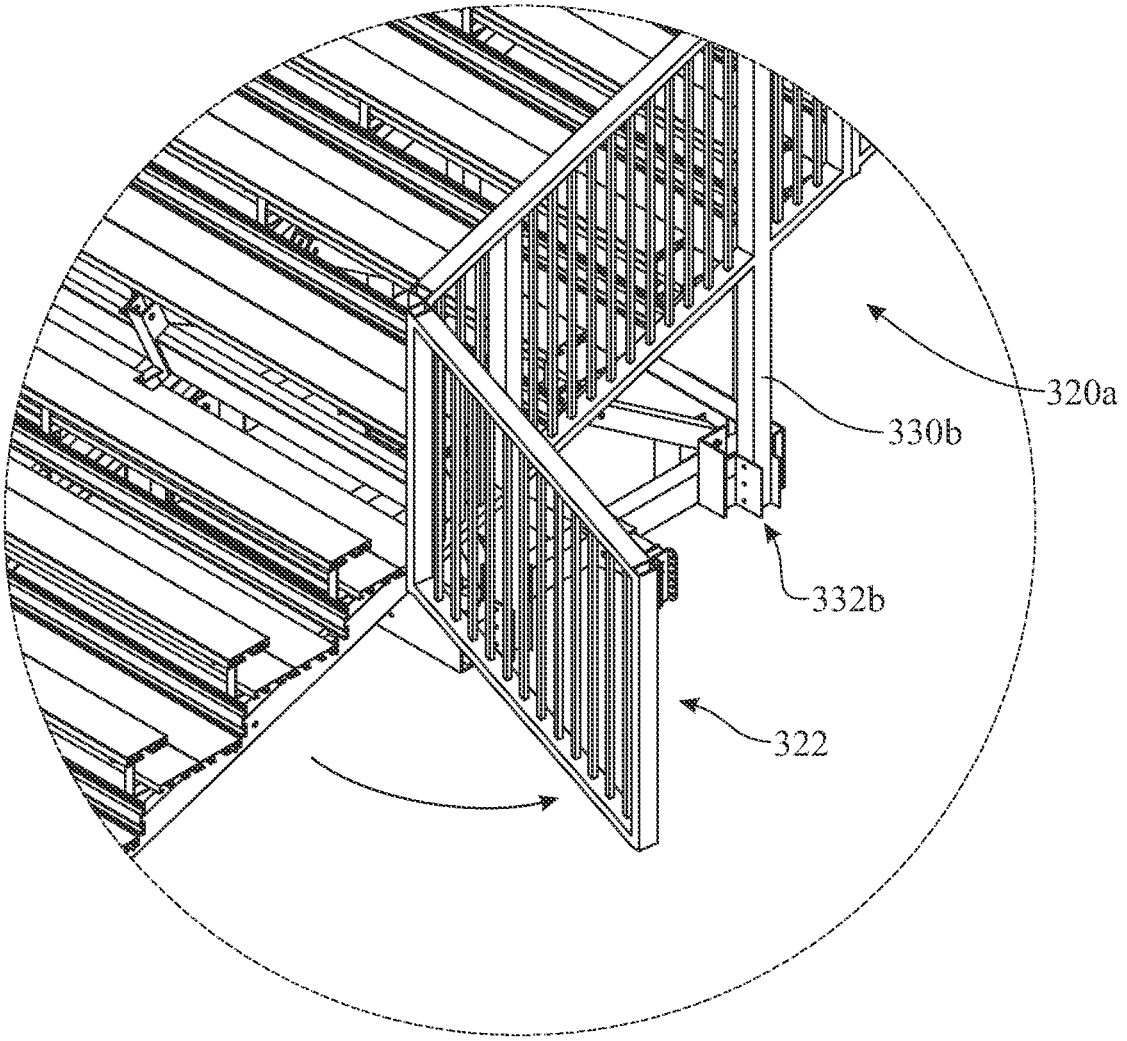
FIG. 9 presents an enlarged, sectional, perspective view of the fence system originally disclosed in FIG. 8 according to the second embodiment of the present invention, illustrating how a section of fence can pivot open.
Figure 10:
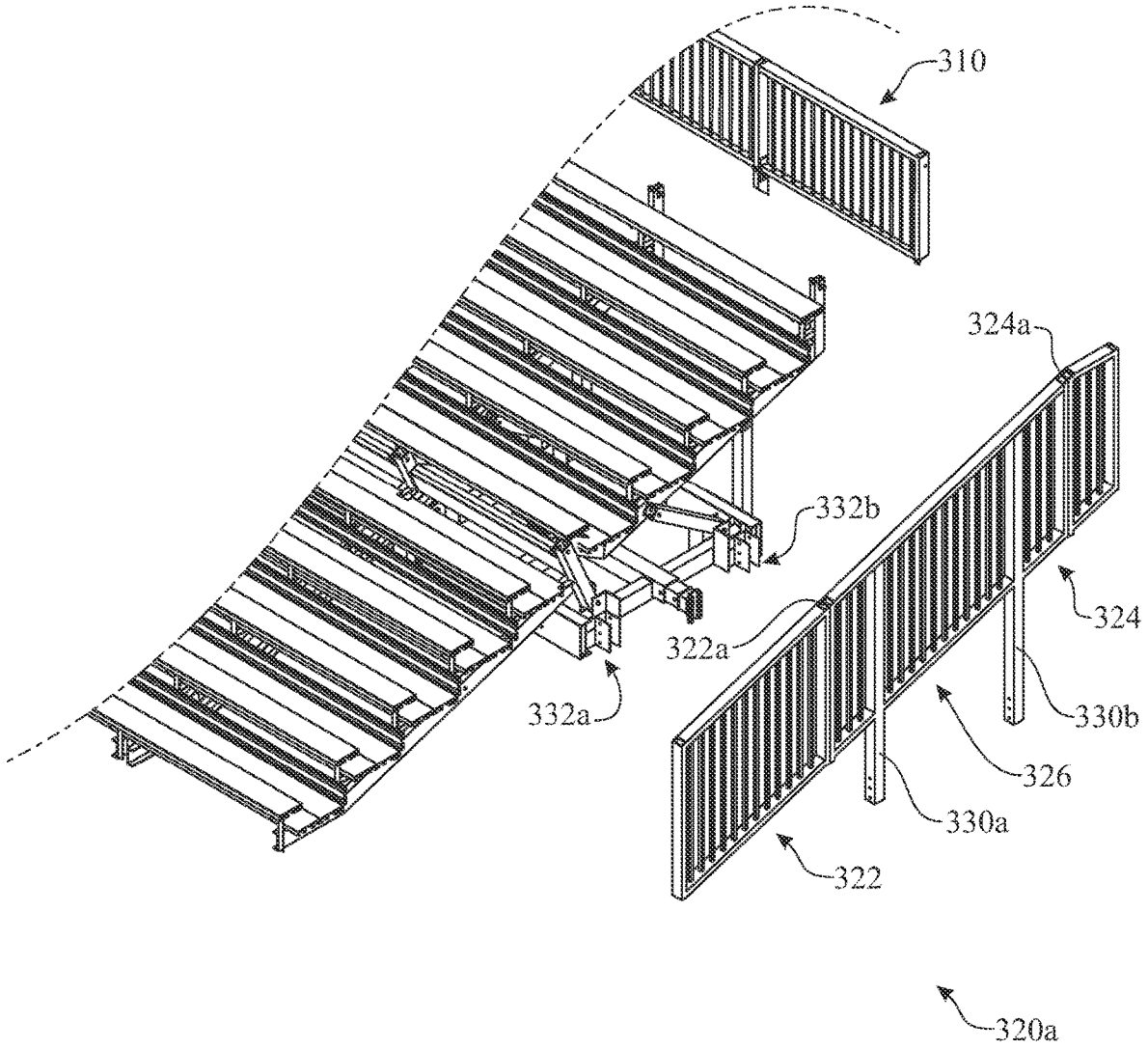
FIG. 10 presents a sectional perspective view of the fence system originally disclosed in FIG. 8 according to the second embodiment of the present invention, illustrating disassembly of the fence system from the bleacher system and the interchangeable property of the side and back fence sections.

Referring now to FIGS. 8-10, with continuing reference to FIGS. 3 and 5-7, the present invention includes a selectively removable fence system generally illustrated at 300, according to a second embodiment of the present invention. The fence system 300 includes a rear fence section 310 and a pair of similarly constructed side fence sections 320*a,b*. The fence system 300 borders the perimeter or boundary of the deployed bleacher system 10 as an enclosure serving as a safety feature. The representative side fence section 320*a* includes a pivotable front fence or gate 322, a pivotable rear fence or gate 324, and an intermediate fence 326 between gates 322, 324. The front gate 322 pivots rearward relative to intermediate fence 326 at pivot axis 322*a*, while rear gate 324 pivots forward relative to intermediate fence 326 at pivot axis 324*a* (FIGS. 3 and 9). These pivoted positions for front gate 322 and rear gate 324 of side fence 320*a* are suitable for travel. The side fence system 320*a,b* is designed independently of the bleacher system 10 and does not fold along with the bleacher between travel and open positions. This is accomplished by attaching the side fence support brackets directly to the trailer framing. For example, side fence section 320*a* is equipped with a pair of support posts 330*a,b* that are selectively removable, attachable, and otherwise connectable to a pair of support brackets 332*a,b*, respectively, provided on the framing of trailer 12. The attachment of support posts 330*a,b* to the trailer frame via the pair of support brackets 332*a,b* places the side fence section 320*a* in adjacent immediate proximity to a lateral edge of bleacher system 10 to adequately function as a peripheral fence boundary or border (FIGS. 8 and 9). The other side fence section 320*b* is similarly arranged.

The rear or back safety fence section 310 is designed to pivot and has 2 fixed locations. The first pivot location is the travel location, which places the back fence 310 in a vertical position and allows for safe code compliant use (FIG. 5). The second pivot location places the back fence section 310 in an angled position folding forward into the bleacher system 10 during opening deployment (FIGS. 6 and 7). This motion and new location of the fence system 300 allows for a lower total clearance height of the overall bleacher system 10 when in travel/highway/transport position.

The fence system 300 can be removed and replaced or repaired with modifications to the bleacher system if codes change or damages occur, keeping maintenance costs lower. Additionally, the fence system 300 can be removed and multiple bleachers can be pushed together to make longer continuous units without a fence between them. This is accomplished by using a custom-made connecter plank, for example. In addition, the side safety fence system 320*a,b* folds 2 times, once from the back forward and once from the front backwards to overlap for travel position (FIG. 3). This design allows for the width of the total trailer to be less than the maximum 102" allowed by DOT regulations. Depending on the location of the fold and the number of rows of the bleacher, the total width can be as low as 80".

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents

What is claimed is:

1. A bleacher system comprising:

a frame;

an upper bleacher section and a lower bleacher section, wherein each one of the upper bleacher section and the lower bleacher section comprises a respective lower end and a respective upper end;

a hydraulic device, comprising opposite, first and second longitudinal ends, the hydraulic device configured to controlledly and longitudinally retract from an expanded configuration to a compressed configuration in which the first and second longitudinal ends are closer to one another with respect to the expanded configuration; and first, second, third, fourth, fifth and sixth pivot points, wherein:

the first, third and fifth pivot points are located at the frame, the first and fifth pivot points arranged frontward and rearward of the third pivot point, respectively, the second, fourth and sixth pivot points are movable with respect to the frame, the first pivot point pivotably connects the first longitudinal end of the hydraulic device to the frame, the second pivot point pivotably connects the second longitudinal end of the hydraulic device to the lower bleacher section, the third pivot point pivotably connects the upper end of the lower bleacher section to the frame, the fourth pivot point is spaced apart from the third pivot point and pivotably connects the upper end of the lower bleacher section to the lower end of the upper bleacher section, the fifth pivot point pivotably connects a connecting link to the frame, and the sixth pivot point pivotably connects the upper bleacher section to the connecting link; wherein the bleacher system is selectively deployable in:

a closed position, in which the hydraulic device is expanded, and the upper and lower bleacher sections are pivoted towards one another about the fourth pivot point, and an open position, in which the hydraulic device is compressed, and the upper and lower bleacher sections are pivoted away from one another about the fourth pivot point such that the upper and lower bleacher sections protrude rearward and frontward from opposite front and rear sides of the frame, respectively; wherein the bleacher system is configured to controlledly transition from the closed position to the open position by a hydraulic-based resistance to compression exerted by the hydraulic device.

2. The bleacher system of claim 1, wherein, in the closed position of the bleacher system, the second pivot point is arranged rearward of and higher than the first pivot point.

3. The bleacher system of claim 2, wherein, in the closed position of the bleacher system, the second pivot point is arranged rearward of and higher than the third pivot point.

4. The bleacher system of claim 3, wherein, in the closed position of the bleacher system, the second pivot point is arranged frontward of and higher than the fourth pivot point.

5. The bleacher system of claim 1, wherein, in the open position of the bleacher system, the second pivot point is arranged frontward of the first pivot point.

6. The bleacher system of claim 1, wherein, in the closed position of the bleacher system, the fourth pivot point is arranged rearward of the third pivot point and frontward of the fifth pivot point.

7. The bleacher system of claim 6, wherein, in the closed position of the bleacher system, the fourth pivot point is arranged frontward of and lower than the sixth pivot point.

8. The bleacher system of claim 1, wherein, in the open position of the bleacher system, the fourth pivot point is arranged higher than the third pivot point.

9. The bleacher system of claim 8, wherein, in the open position of the bleacher system, the fourth pivot point is arranged frontward of the third pivot point.

10. The bleacher system of claim 1, wherein, in the closed position of the bleacher system, the sixth pivot point is arranged higher than the fifth pivot point.

11. The bleacher system of claim 10, wherein, in the closed position of the bleacher system, the sixth pivot point is arranged frontward of the fifth pivot point.

12. The bleacher system of claim 1, wherein, in the open position of the bleacher system, the sixth pivot point is displaced frontward and downward with respect to the closed position of the bleacher system.

13. The bleacher system of claim 12, wherein, in the open position of the bleacher system, the sixth pivot point is arranged rearward of and higher than the third pivot point.

14. The bleacher system of claim 13, wherein, in the open position of the bleacher system, the sixth pivot point is arranged rearward of and lower than the fourth pivot point.

15. The bleacher system of claim 1, wherein the hydraulic device includes a piston and cylinder combination.

16. The bleacher system of claim 1, further comprising:

a weight detection module configured to sense a load applied by the bleacher system and to generate a load signal representative thereof, and a controller configured to control the hydraulic device in response to the load signal from the weight detection module.

17. The bleacher system of claim 16, wherein the controller is configured to increase said hydraulic-based resistance to compression of the hydraulic device responsively to the load signal from the weight detection module during a transition of the bleacher system from the closed position to the open position.

18. The bleacher system of claim 1, wherein the frame, the upper and lower bleacher sections, and the hydraulic device are carried by and transportable on a trailer system.

* * * * *